US008734199B2

(12) United States Patent
Bruder

(10) Patent No.: US 8,734,199 B2
(45) Date of Patent: May 27, 2014

(54) TOY COMPONENT GROUP AND TOY VEHICLE

(75) Inventor: Paul Heinz Bruder, Fürth (DE)

(73) Assignee: Bruder Spielwaren GmbH and Co. KG, Fürth (DE)

( * ) Notice: Subject to any disclaimer, the term of this patent is extended or adjusted under 35 U.S.C. 154(b) by 675 days.

(21) Appl. No.: 12/893,363

(22) Filed: Sep. 29, 2010

(65) Prior Publication Data

US 2011/0189923 A1 Aug. 4, 2011

(30) Foreign Application Priority Data

Jan. 29, 2010 (DE) ..... 20 2010 001 555 U

(51) Int. Cl.
*A63H 17/00* (2006.01)

(52) U.S. Cl.
USPC ..... 446/431; 446/437; 446/460; 446/465

(58) Field of Classification Search
USPC ..... 446/431, 433, 437, 460, 465, 466, 468, 446/469; 74/89.23, 53–55, 490.12, 491; 280/99, 101
See application file for complete search history.

(56) References Cited

U.S. PATENT DOCUMENTS

| | | | | | |
|---|---|---|---|---|---|
| 184,892 | A | * | 11/1876 | O'Daniel | 280/101 |
| 332,084 | A | * | 12/1885 | Keech et al. | 280/101 |
| 420,872 | A | * | 2/1890 | Fleshman | 280/101 |
| 420,873 | A | * | 2/1890 | Fleshman | 280/101 |
| 1,652,135 | A | | 12/1927 | Chein | |
| 4,610,455 | A | * | 9/1986 | Furukawa et al. | 180/410 |
| 4,713,981 | A | * | 12/1987 | Zahn | 74/490.15 |
| 5,273,480 | A | * | 12/1993 | Suto | 446/456 |
| 5,362,080 | A | * | 11/1994 | Bishop et al. | 180/415 |
| 5,531,466 | A | * | 7/1996 | Hayashi | 280/91.1 |
| 5,584,743 | A | * | 12/1996 | Beaulieu | 446/427 |
| 5,873,200 | A | * | 2/1999 | Henderson | 49/343 |
| 6,019,565 | A | * | 2/2000 | Gesuale | 414/458 |
| 6,142,426 | A | * | 11/2000 | Zaro et al. | 246/125 |
| 6,620,023 | B2 | * | 9/2003 | Yeung | 446/466 |

FOREIGN PATENT DOCUMENTS

DE 93 02 435 U1 4/1993

* cited by examiner

*Primary Examiner* — Gene Kim
*Assistant Examiner* — Urszula M Cegielnik
(74) *Attorney, Agent, or Firm* — Browdy and Neimark, PLLC

(57) ABSTRACT

A toy component group (17) has a loading arm (18) with a free end for lifting a load and with a connecting end (19) via which the loading arm (18) is mounted on a frame (20) of the component group (17). An activating device (21) serves for adjusting a loading arm setting angle (α) and, thereby, for lifting the free end of the loading arm (18). The activating device (21) comprises an activating element (23), a spindle (22) mounted on the frame (20) which is in drive connection with the activating element (23) for rotation about a spindle axis (24). Further, the activating device (21) comprises a spindle nut (25) with at least one guiding element (26) and a connecting link (27) secured to the loading arm (18). The connecting link (27) cooperates with the at least one guiding element (26) of the spindle nut (25) for link guiding. Such link guiding via said at least one guiding element (26) and the connecting link (27) is designed such that a power development of the activating element (23) on the loading arm (18) is a function of the loading arm setting angle (α). A toy component having an improved suitability for playing with is the result.

5 Claims, 9 Drawing Sheets

TOY COMPONENT GROUP AND TOY VEHICLE

FIELD OF THE INVENTION

The invention relates to a toy component group with a loading arm with an adjustable loading arm setting angle. The invention also relates to a toy with such a component group and a toy vehicle comprising a chassis, a plurality of running wheels, which are attached to the chassis, and an activating element for steering the toy vehicle.

BACKGROUND OF THE INVENTION

A toy component group of this kind, a toy with such a component group and a toy vehicle of the aforementioned type are known from DE 93 02 435 U1 and U.S. Pat. No. 1,652,135.

SUMMARY OF THE INVENTION

An objective of the present invention is to develop a toy component group of the aforementioned type, so as to improve its suitability for playing with.

Said objective is achieved according to the invention by a
- toy component group
- with a loading arm,
  - with a free end for lifting a load,
  - with a connecting end, via which the loading arm is mounted on a frame of the component group,
- with an activating device for adjusting a loading arm setting angle and thereby for lifting the free end of the loading arm (18), which comprises
  - an activating element,
  - a spindle mounted on the frame, which is in drive connection with the activating element for rotation about a spindle axis,
  - a spindle nut with at least one guiding element,
  - a connecting link secured to the loading arm, said connecting link cooperating with the at least one guiding element of the spindle nut for link guiding
  - wherein the link guiding via said at least one guiding element (26) and the connecting link (27) is designed such that a power development of the activating element (23) on the loading arm (18) is a function of the loading arm setting angle ($\alpha$).

According to the invention it has been recognized that a link guide of an activating device for adjusting a loading arm setting angle means that it is possible to design the power development of the activating element on the loading arm as a function of the setting angle. This makes it possible for the introduction of power to be adapted to the play use of the toy component group. The force can be introduced via the activating element most strongly in particular at setting angles where the strongest force is required to change the setting angle of the loading arm. This is the case in particular where the greatest torque acts on the loading arm. The connecting link can be designed in particular so that an activating force on the activating element is produced that is practically independent of the setting angle of the loading arm. The arrangement of the connecting link can be such that independently of the loading arm setting angle a distance between the at least one guiding element of the spindle nut and a pivot axle, via which the connecting end of the loading arm is articulated onto the frame, is reduced continually and in particularly progressively.

The spindle nut can comprise exactly two opposite guiding elements, which cooperate with two spaced apart parallel part connecting links of the connecting link. The spindle nut then runs between said two part connecting links.

A curved design of the connecting link so that with a given activation force of the activating element a lifting force, which is exerted via the activating element on the loading arm, is greater at small setting angles than at larger setting angles, increases the clearance of the design and thus the options of forming the dependency of an activating force on the setting arm of the loading arm. A rotation of the spindle with small setting angles can then result in a lower lifting angle than with greater setting angles. The design of the connecting link, in particular the curved design of the connecting link can be such that with loading arm setting angles of between 0° (horizontally running loading arm) and 40° the lifting force is greater than above 40°.

A design of the connecting link guide such that in the case of overload on the loading arm the at least one guiding element disengages from the connecting link, can help to avoid damage to the toy component group.

Run-on oblique surfaces for facilitating the insertion of the at least one guiding element, facilitate the return of the at least one guiding element into the connecting link.

With a telescopic loading arm the advantages of the connecting link according to the invention are particularly effective.

The advantages of a toy with a component group according to the invention correspond to those explained above in connection with the toy component group.

A further objective of the invention is to improve the steerability of a toy vehicle.

Said objective is achieved according to the invention by a toy vehicle comprising a steering device, which comprises a steering plate articulated onto all running wheels, said steering plate being movable by the steering activating element relative to the chassis, and axle knuckles supporting the running wheels said axle knuckles being articulated both onto the steering plate and also the chassis.

On the basis of the steering device according to the invention all of the running wheels can be steered by means of a steering activating element. This results in a very maneuverable toy vehicle.

A gear transmission, in which the steering plate has a row of teeth, which cooperates with a gearwheel driven by the steering activating element and mounted on the chassis for moving the steering plate, is structurally simple.

A one-piece design, in which the gearwheel is formed in one piece on the steering activating element, is particularly inexpensive.

An arrangement of the steering activating element rotatably about an axle perpendicular to a chassis plane defined by the chassis, enables the intuitive steering of the toy vehicle.

Axle knuckles being attached individually onto the chassis enable the adjustment of the running wheels of the toy vehicle to uneven terrain, which further increases the play value of the toy vehicle.

An exemplary embodiment of the invention is explained in more detail in the following with reference to the drawing.

DESCRIPTION OF THE PREFERRED EMBODIMENT

Figure 3:
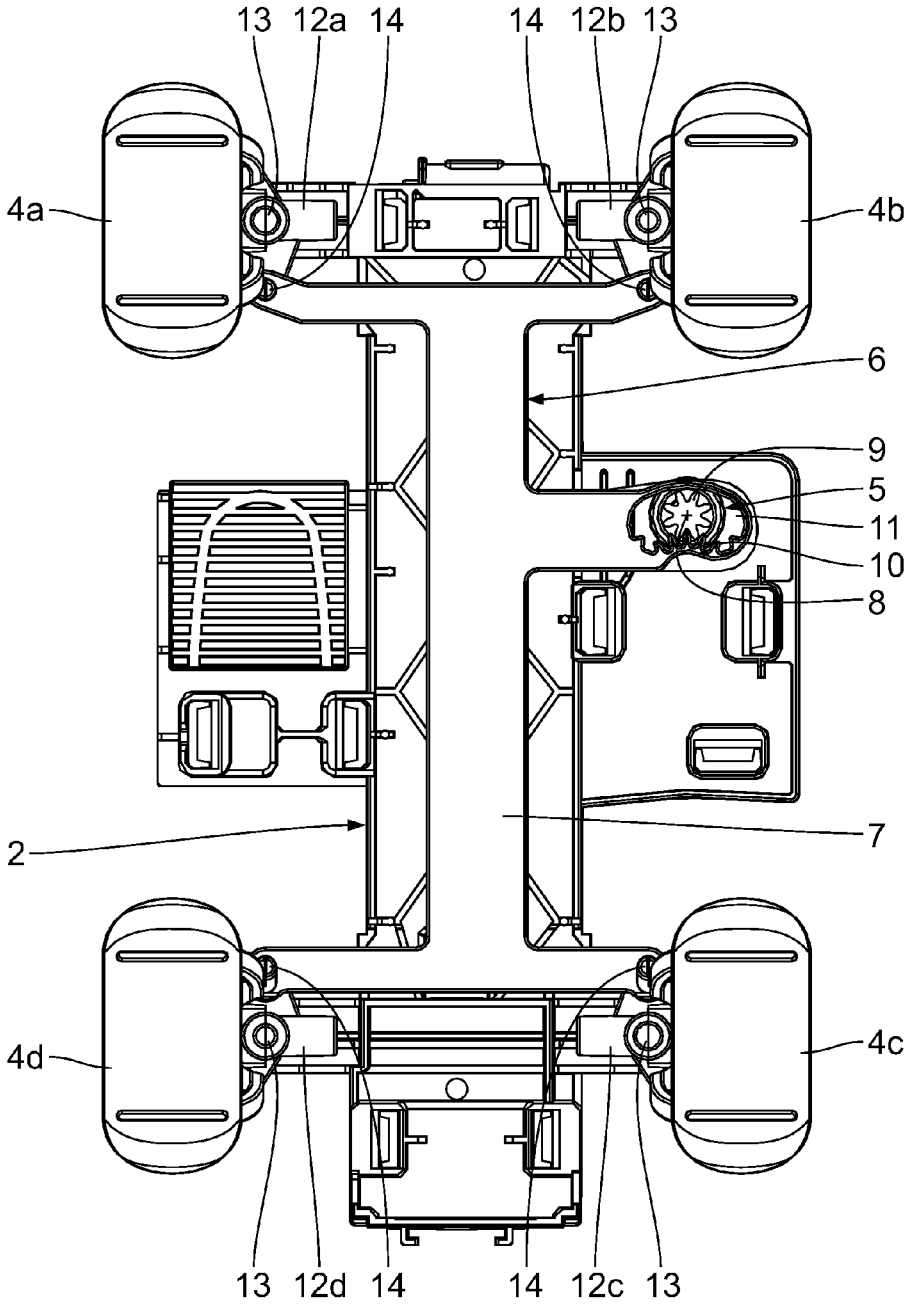
FIG. 3 shows a plan view of an assembly group of the toy vehicle with a chassis, four running wheels provided with spray protective covers, an activating element for steering the toy vehicle and a steering device with a steering plate and axle knuckles supporting the running wheels, in a steering position "straight on"
Figure 4:
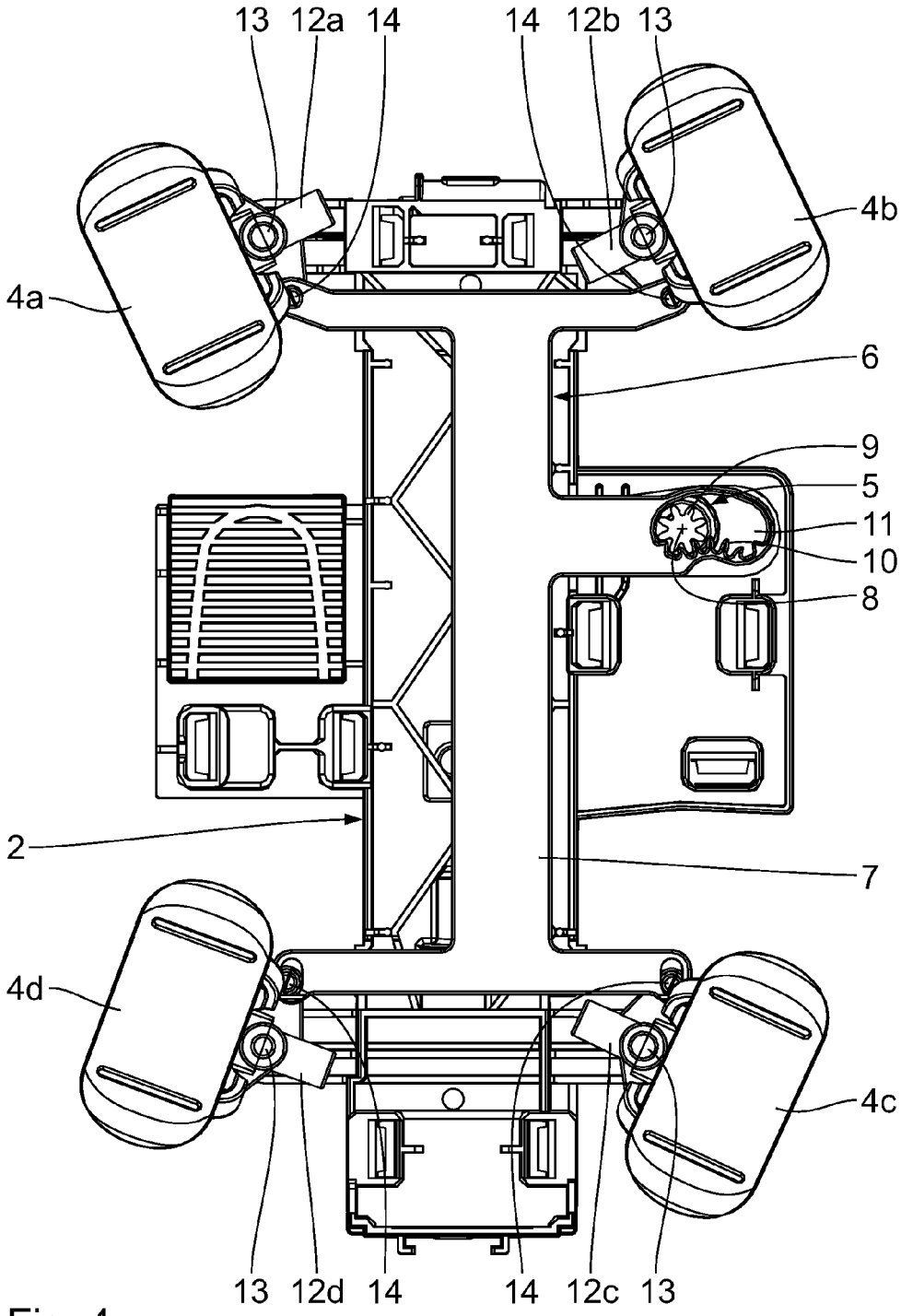
FIG. 4 shows the assembly group according to FIG. 3 in a steering position "maximum left steer"
Figure 5:
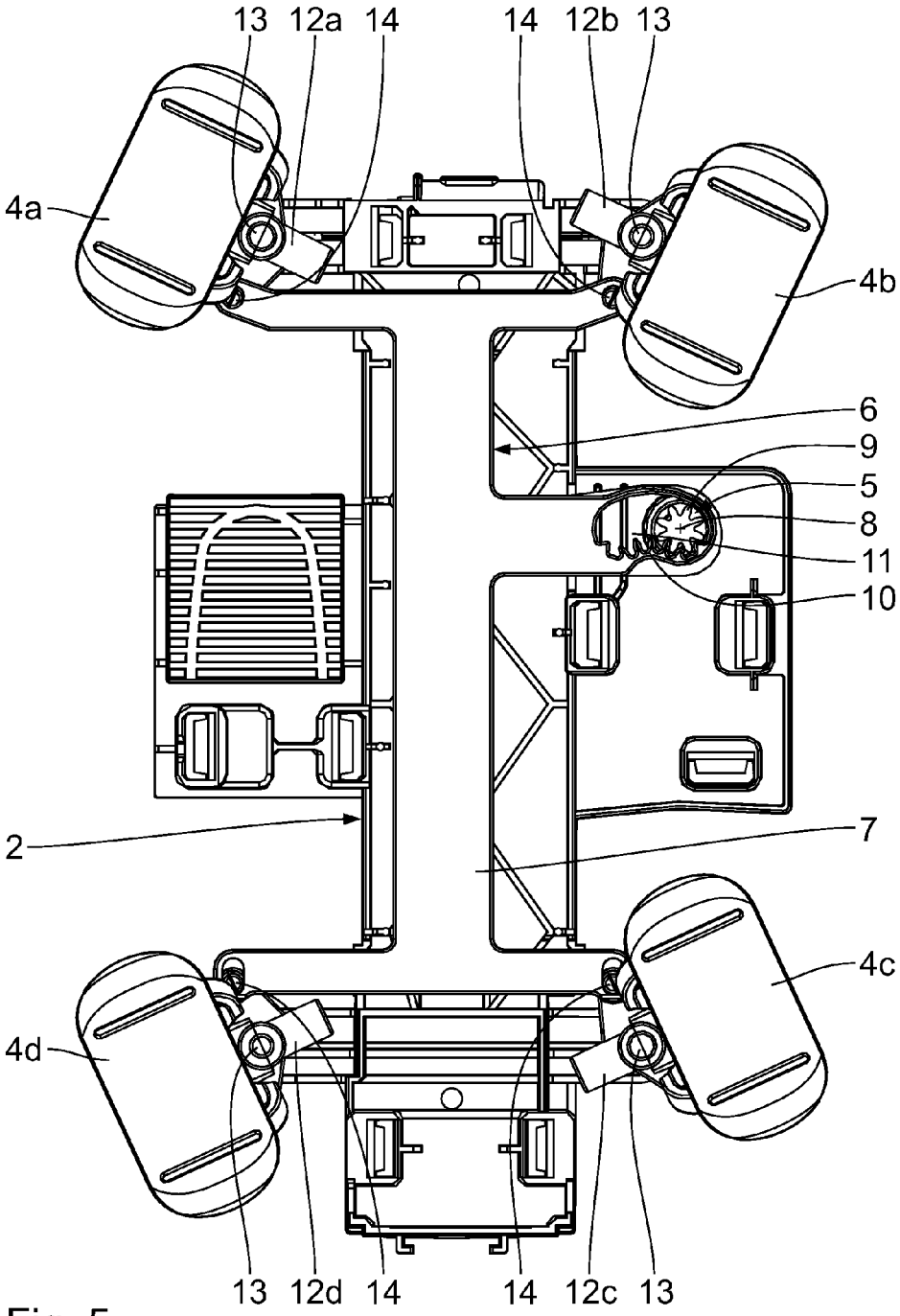
FIG. 5 shows the assembly group according to FIG. 3 in a steering position "maximum right steer"
Figure 6:
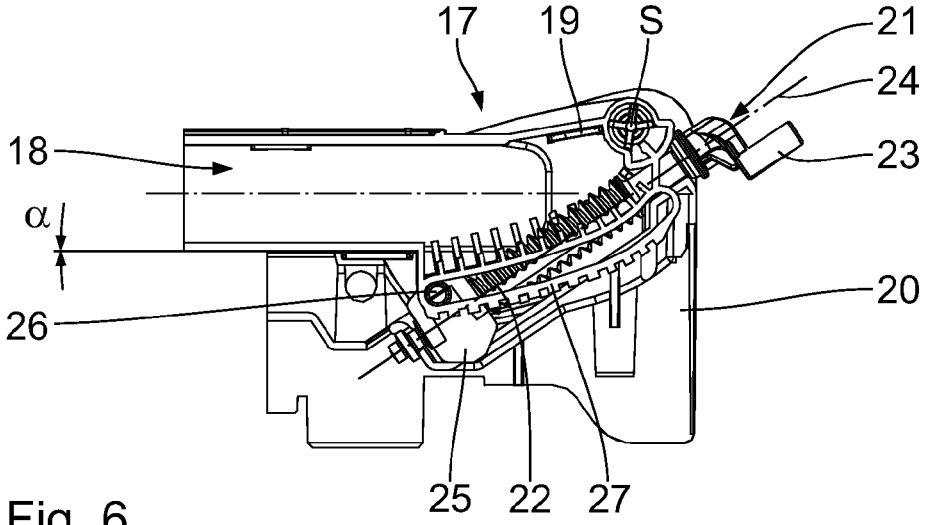
FIG. 6 shows a toy component group of the toy vehicle with a telescopic loading arm and an activating device for adjusting a loading arm setting angle, wherein the loading arm is shown in the maximum lowered position (loading arm setting angle $\alpha=0°$)
Figure 7:
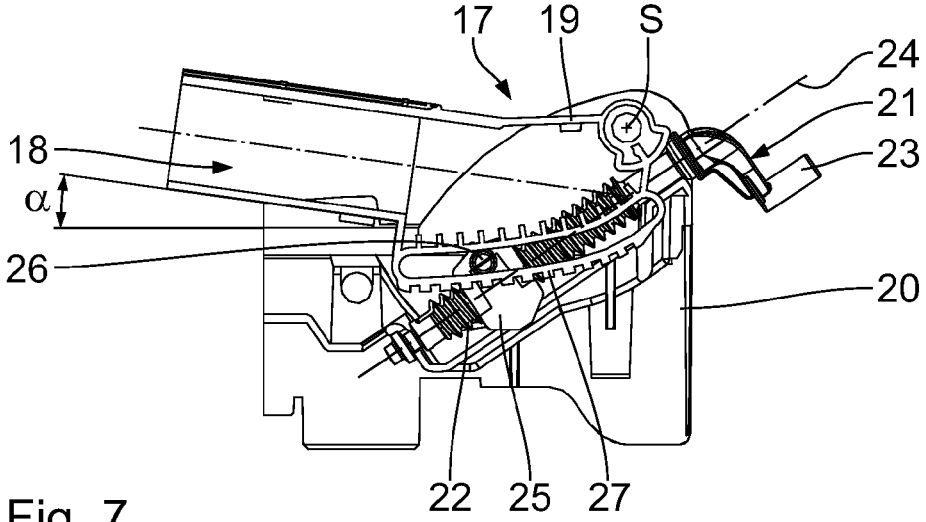
FIGS. 7 to 11 shows a sequence of positions of the loading arm with ever greater loading arm setting angles.
Figure 8:
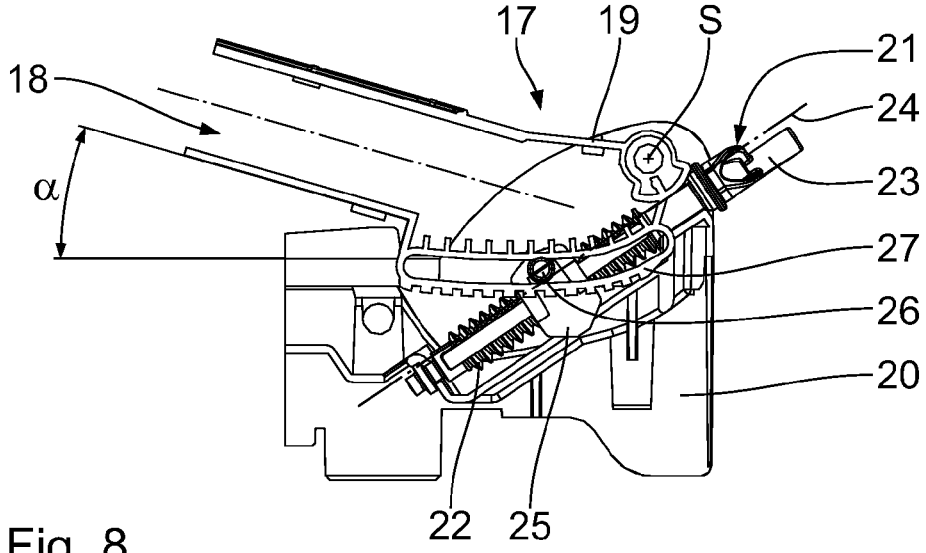
Figure 9:
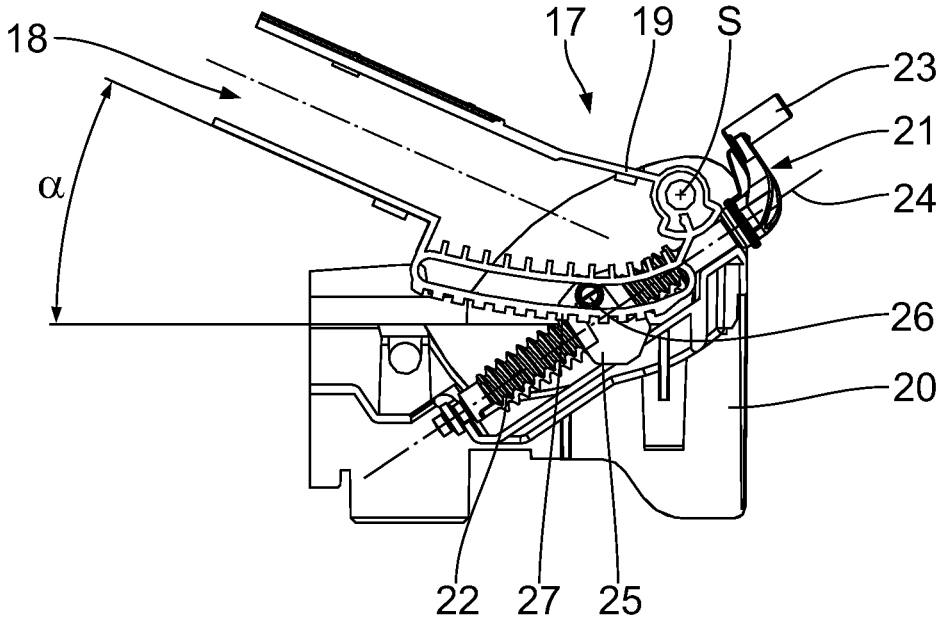
Figure 10:
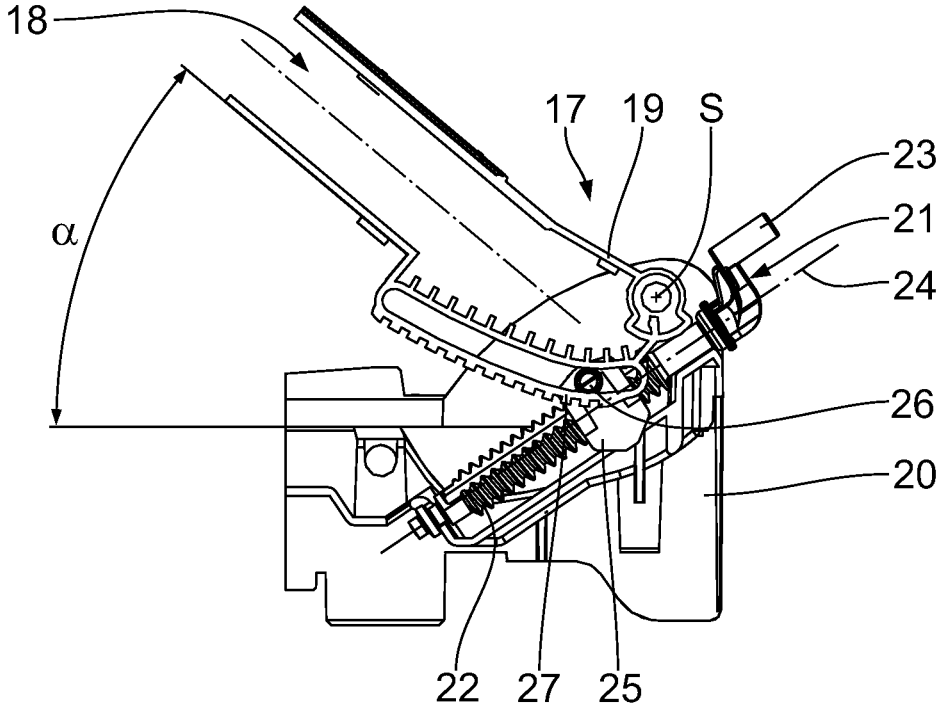
Figure 11:
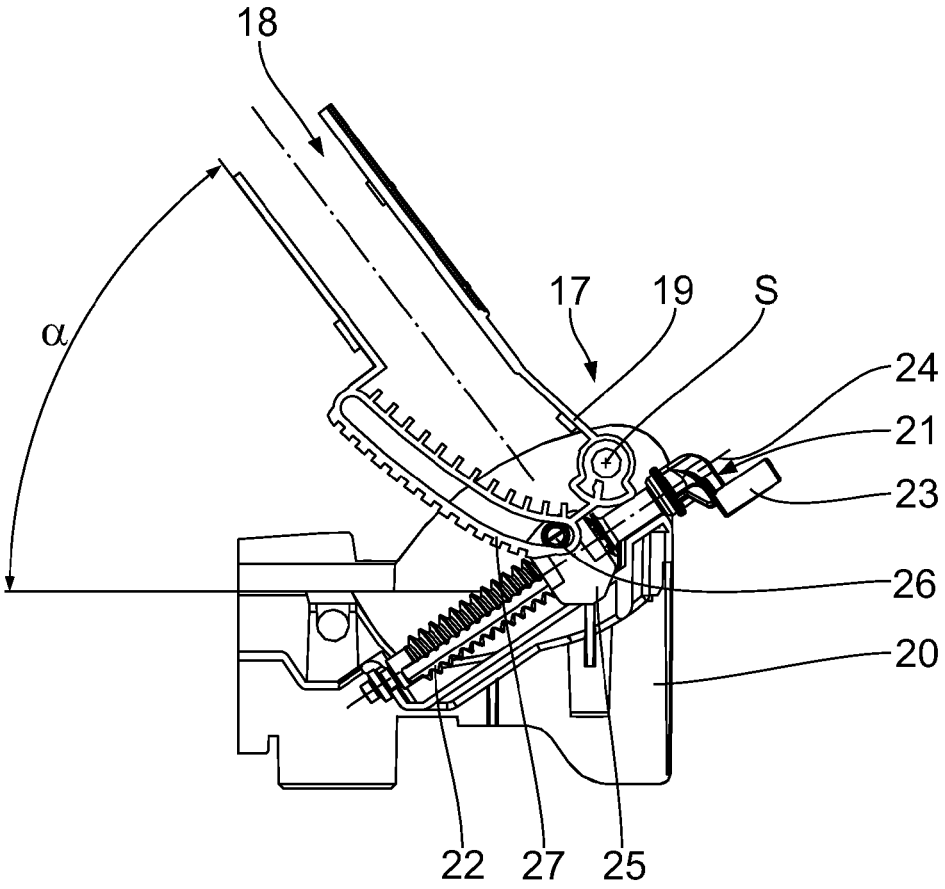

A toy vehicle 1 has a chassis 2 shown in more detail in FIGS. 3 to 5 and a total of four running wheels 3, which are attached to the chassis 2. The running wheels 3 are covered at the top by spray protective covers 4. In the drawings according to FIGS. 3 to 5, in which all four spray protective covers 4 can be seen, the spray protective covers 4, beginning with the front left spray protective cover 4*a* in driving direction shown on the top left in FIGS. 3 to 5 are given letters in clockwise direction.

For steering the toy vehicle 1 a steering activating element 5 is used in the form of a rotatable button activated manually and provided with knurling.

For steering the running wheels 3 the toy vehicle has a steering device 6, which can be operated by the steering activating element 5. The steering device 6 has a steering plate 7, which can be moved by means of the steering activating element 5 relative to the chassis 2. For this the steering activating element 5 is mounted rotatably on the chassis 2 about a rotational axis 8 which is perpendicular on a chassis plane defined by the chassis which in turn is parallel to the plane of the drawing of FIGS. 3 to 5.

At the level of the steering plate 7 the steering activating element 5 has a one-piece formed gearwheel 9. The latter meshes with a row of teeth 10, which runs along a longitudinal side of an elongated hole-like through opening 11 in the steering plate 7. The through opening 11 is also a window for the passage of the steering activating element 5 through the steering plate 7. The row of teeth 10 does not run straight, but follows the convex curve of the rim of the through opening 11. The through opening 11 is formed in a cross-arm of the steering plate 7, which extends at the level of the steering activating element 5 from a main plate section of the steering plate 7 running along the travelling direction of the toy vehicle 1.

In the area of the running wheels 3 on the steering plate 7 axle knuckles 12 are attached, which according to their allocation to the running wheels are also given letters like the spray protection covers 4. The axle knuckles 12*a* to 12*d* in turn each support one of the wheels 3. The axle knuckles 12*a* to 12*d* are in turn articulated onto the chassis 2 about pivot axes 13 also running perpendicular to the chassis plane.

The articulation points 14 of the cross-arms of the steering plate 7 assigned to the respective axle knuckles 12*a* to 12*d* are spaced apart from the pivot axes 13, so that a displacement of the steering plate 7 relative to the chassis 2 leads to the rotation of the axle knuckles 12*a* to 12*d* about the pivot axes 13.

FIG. 3 shows the steering plate 7 in a "straight on" position relative to the chassis 2. In this position the gearwheel 9 meshes with a middle section of the row of teeth 10.

FIG. 4 shows the steering device 6 in position "maximum left steer". In this position the toy vehicle 1 can curve to the left with a minimum curve radius. In this position the two running wheels with the spray protection covers 4*a*, 4*b* are rotated anticlockwise from a straight driving position and the two other running wheels with the spray protection covers 4*c*, 4*d* are rotated in clockwise direction. The gearwheel 9 of the steering activating element 5 cooperates with the outermost left section of the row of teeth 10.

FIG. 5 shows the inverse position to FIG. 4 "maximum right steer". In this position of the steering device 6 the toy vehicle 1 can curve to the right with a minimum curve radius. The gearwheel 9 of the steering activating element 5 cooperates with the outermost right section of the row of teeth 10.

Figure 1:
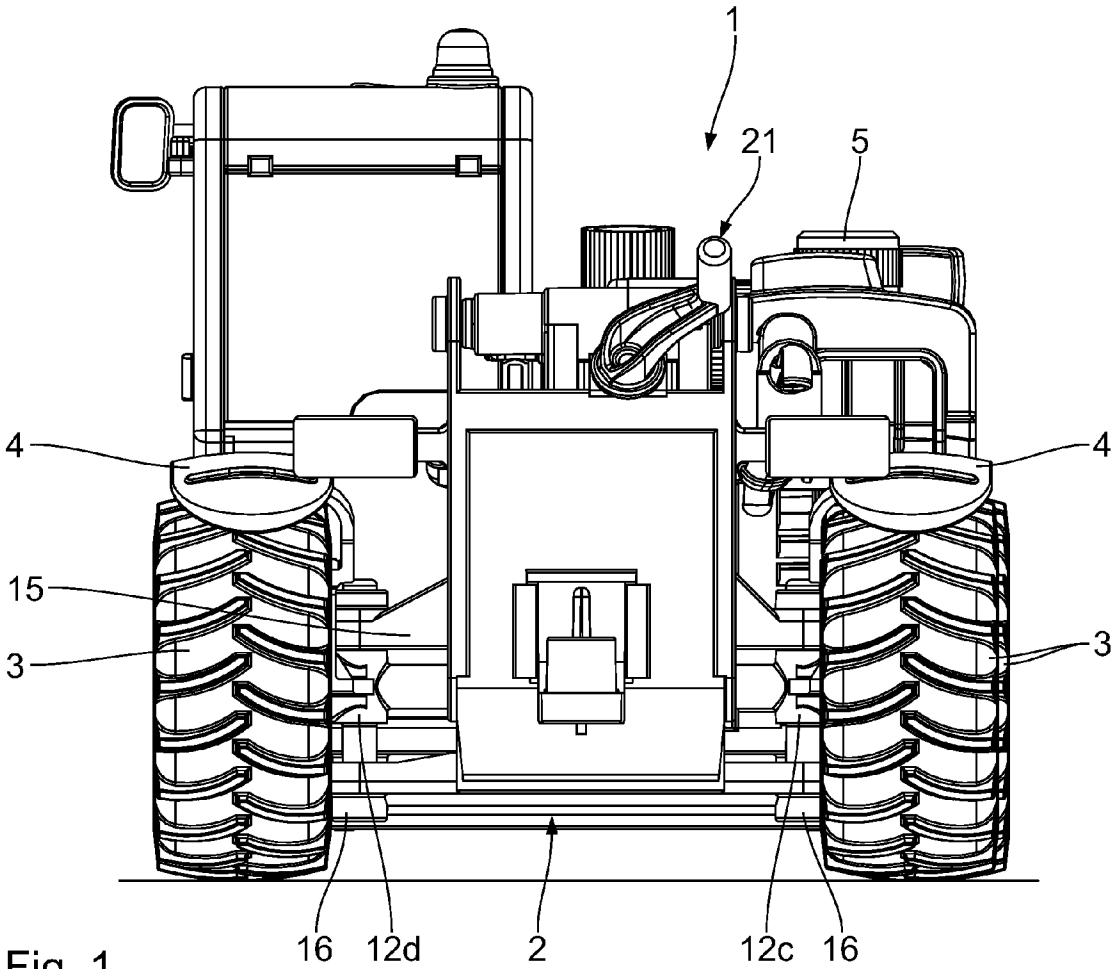
FIG. 1 shows a rear-side view of a toy vehicle in the form of a telescopic loader, placed on even ground.

The axle arms 12*a* to 12*d* are attached with radial clearance individually onto the chassis 2. The function of this radial clearance is clarified in a comparison of FIGS. 1 and 2. FIG. 1 shows the toy vehicle 1 on even and horizontal ground. All four axle knuckles 12 are then in contact with upper stops 15 of the chassis 2.

Figure 2:
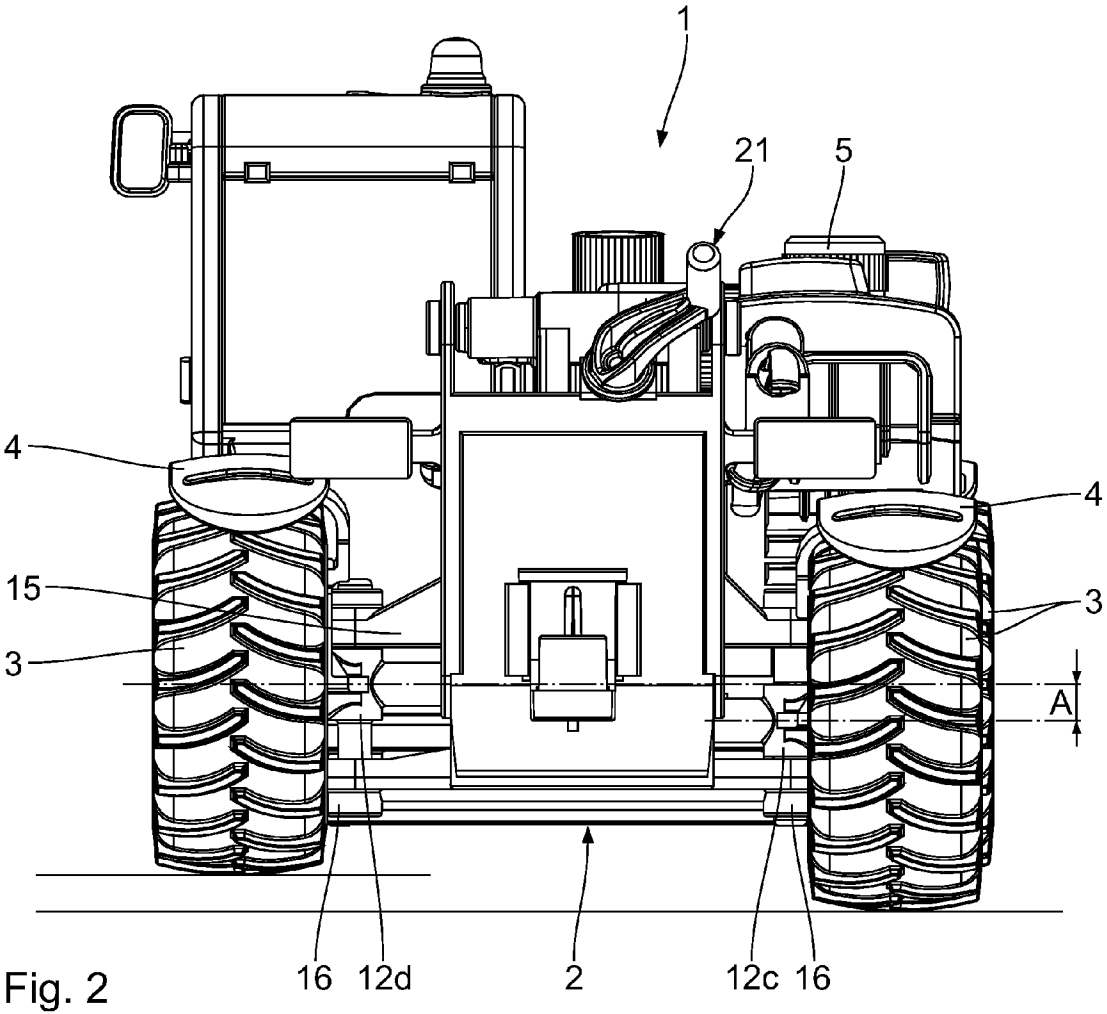
FIG. 2 shows the toy vehicle according to FIG. 1 with a running wheel position adjusted to uneven ground.

FIG. 2 shows the toy vehicle 1 with a running wheel arrangement for uneven ground and in the region of the rear running wheels of the toy vehicle 1 terrain which falls from left to right. The relative position of the axle knuckle 12*d* to the upper stop 15 has not changed. The right axle knuckle 12*c* in FIG. 2 can move downwards owing to its radial clearance relative to the chassis 2, so that between the axle knuckle 12*c* and the assigned upper stop 15 of the chassis 2 there is a spacing A. In this way the running wheel 3 assigned to the axle knuckle 12 can ensure contact with the uneven ground. The radial clearance of the axle knuckles 12 relative to the chassis 2 is limited downwards by the lower chassis stops 16 for the axle knuckles 12.

The toy vehicle 1 also has a toy component group 17, details of which are shown in FIGS. 6 to 13. The toy component group 17 has a loading arm 18, which can be extended telescopically in a not shown manner. The loading arm 18 has a not shown free end for lifting a load. Opposite this free end is a connecting end 19 of the loading arm 18, via which the latter is mounted on a frame 20 of the toy component group 17. The chassis 2 of the toy vehicle 1 is fixed onto the frame 20.

An activating device 21 is used for adjusting a loading arm setting angle $\alpha$ and thus for lifting the free end of the loading arm 18. The loading arm setting angle $\alpha$ can be defined continually by the activating device 21, as can be seen from the sequence of FIGS. 6 to 11, between a minimum angle of about 0° and a maximum angle of more than 50°. To adjust the loading arm setting angle $\alpha$ the bearing arm 18 is articulated via a swiveling joint with pivot axis S onto the frame 20.

The activating device 21 has a spindle 22 mounted on the frame 20, which spindle is in drive connection with an angle setting activating element 23 in the form of a crankshaft for rotating about a spindle axis 24. The activating device 21 also includes a spindle nut 25 with two opposite guiding elements 26 in the form of bolt-like guiding attachments. The activating device 21 also has a loading arm-secured connecting link 27, which cooperates with the guiding elements 26 of the spindle nut 25 for the link guiding of the spindle nut 25 relative to the loading arm 18. The connecting link 27 is designed to be curved.

This curvature of the connecting link 27 is such that on setting up the loading arm 18 the distance between the guiding elements 26 and the pivot axis S is reduced progressively. At a given activating force which is exerted manually on the angle setting operating element 23, a lifting force, which the activating device 21 exerts manually on the loading arm 18, at small setting angles, in particular at setting angles of in the region of between 0° and 40°, is greater than at larger setting angles, in particular at setting angles of in the region of between 40° and 55°. The rotation of the spindle 22 results at small setting angles in a smaller lifting angle change than at larger setting angles.

In a not shown alternative design the connecting link 27 can also be designed to be linear. In this case the path of the connecting link has to be ensured in which at smaller setting angles there is a greater distance between the guiding elements 26 and the pivot axis S than at larger setting angles. In the shown embodiment both a basic and also linearly approached possible path of the connecting link 27 as well as the curvature of the connecting link 27 to the pivot axis S support the decrease in the lifting force at greater setting angles.

Figure 12:
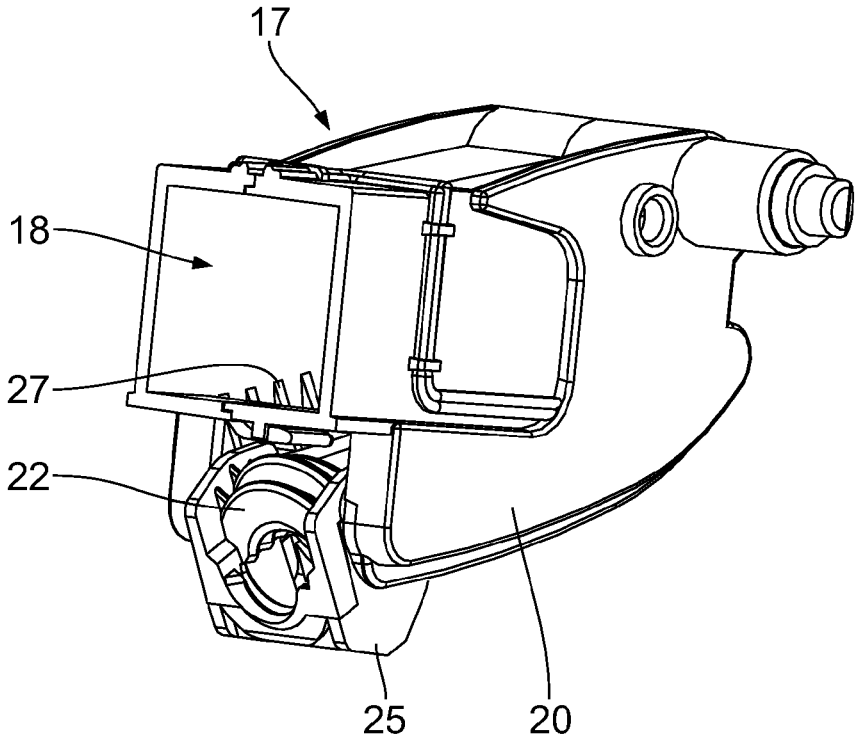
FIG. 12 shows perspectively a section of the activating device with a portion of a spindle mounted on a frame of the component group and a spindle nut engaged in a support arm secured connecting link.
Figure 13:
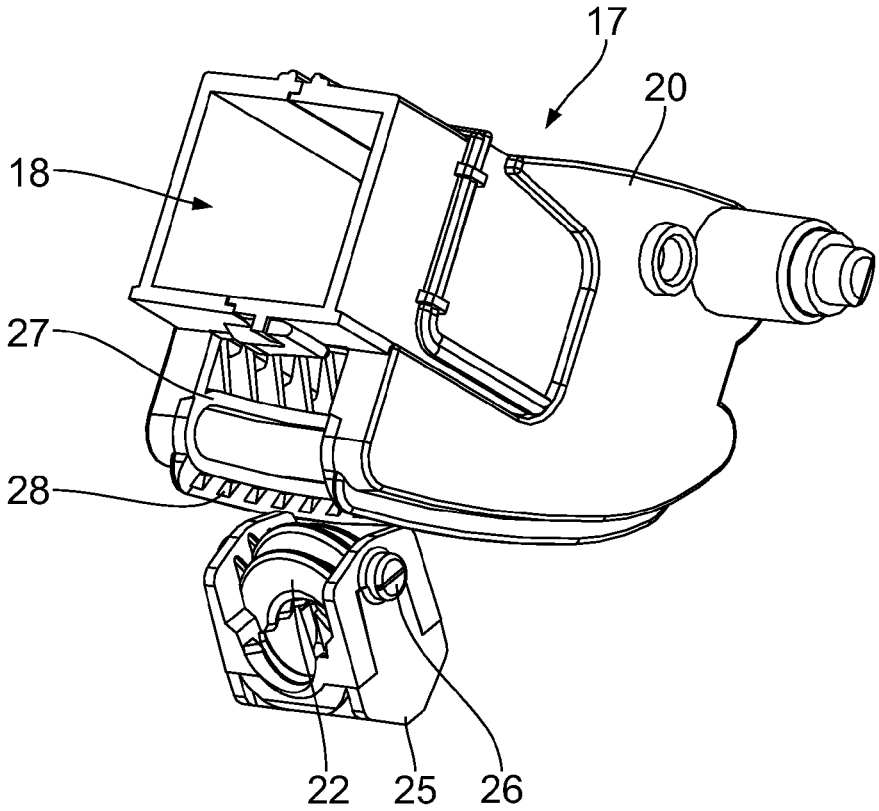
FIG. 13 shows in a view similar to FIG. 12 the assembly group with a spindle nut disengaged from the connecting link.

The link guide with the guiding elements 26 of the connecting link 27 is thus designed such that in the case of an overload acting on the loading arm 18 the guiding elements 26 disengage from the connecting link 27. This is shown in a comparison of FIGS. 12 and 13. FIG. 12 shows the spindle nut 25 with the guiding elements 26 engaged into the connecting link 27, i.e. a position which corresponds to the one according to FIGS. 6 to 11. FIG. 13 shows the spindle nut 25 with guiding elements 26 disengaged from the connecting link 27.

To facilitate the introduction of the guiding elements 26 into the connecting link 27 the connecting link 27 has run-on oblique surfaces 28. If when introducing the guiding elements 26 into the connecting link 27 by means of the spindle nuts 25 and the guiding elements 26 pressure is exerted onto the run-on oblique surfaces 28 of the connecting link 27, the guiding elements 26 force apart the run-on oblique surfaces 28 and thus the two part connecting links of the connecting link 27 assigned to the respective guiding elements 26, until the guiding elements 26 can engage into the connecting link 27.

The toy vehicle 1 has the following play functions: for steering the toy vehicle 1 the steering activating element is operated intuitively like the steering wheel of a vehicle. On rotating the steering activating element 5 to the right the toy vehicle 1 curves to the right and on activating it to the left it curves to the left. By operating the angle setting activating element 23 the setting angle of the loading arm 18 is defined. In the place where the load exerts the greatest torque at the free end of the loading arm, namely in the range of a small setting angle α, due to the design of the connecting link 27 the lifting force, which can be exerted at a given activating force onto the angle setting element 23, is at its greatest. Towards greater setting angles α owing to the lower torque, which the load exerts, a smaller lifting force can be tolerated, so that a rotation of the spindle 22 results in a greater change to the setting angle. In the case of overload on the loading arm 18 the guiding elements 26 disengage from the connecting link 27, before the connecting components are damaged. Owing to the run-on oblique surfaces 28 the guiding elements 26 can be returned more easily into the connecting link 27 to restore the connecting link guide. Additional activating elements can be provided for the telescopic action of the loading arm 18 and for activating a blade which is possibly arranged at the free end of the loading arm 18.

The toy vehicle 1 is made completely of plastic. The components of the toy vehicle 1 are injection molded parts.

What is claimed is:

1. A toy component group (17), comprising:
a loading arm (18),
having a free end configured to lift a load, and
a connecting end (19), via which the loading arm (18) is mounted on a frame (20) of the component group (17),
an activating device (21) configured to adjust a loading arm setting angle (α) and thereby to lift the free end of the loading arm (18), the loading arm setting angle (α) being an angle between the loading arm and a horizontal plane, the activating device comprising:
an activating element (23),
a spindle (22) mounted on the frame (20), which is in drive connection with the activating element (23) configured to rotate about a spindle axis (24),
a spindle nut (25) with at least one guiding element (26),
a connecting link (27) secured to the loading arm (18), one end of the connecting link is pivotally mounted on the pivot axis of the loading arm, the connecting link comprising an internal slot defined along substantially an entire length of the link between the one end and a second end of the connecting link, and said connecting link (27) cooperating with the at least one guiding element (26) of the spindle nut (25) so that the at least one guiding element is moved along the connecting link within the internal slot,
wherein the connecting link (27) is configured such that a force required to move the at least one guiding element (26) is a function of the loading arm setting angle (α), and wherein the connecting link (27) has a curved configuration, so that with a given activation force of the activating element (23), a lifting force, which is exerted via the adjusting element (23) on the loading arm (18), is greater at small setting angles (α) than at larger setting angles (α).

2. A toy component group according to claim 1, wherein the connecting link (27) is configured and the at least one guiding element (26) are configured such that the at least one guiding element (26) disengages from the connecting link (27) when an overload is placed on the loading arm (18).

3. A toy component group according to claim 2, wherein the connecting link (27) comprises run-on oblique surfaces (28) configured to facilitate the insertion of the at least one guiding element (26).

4. A toy component group according to claim 1, wherein the loading arm (18) is telescopic.

5. A toy (1) with a component group (17), comprising:
a loading arm (18) having
a free end for lifting a load, and
a connecting end (19), via which the loading arm (18) is mounted on a frame (20) of the component group (17),
an activating device (21) configured to adjust a loading arm setting angle (α) and thereby to lift the free end of the loading arm (18), the loading arm setting angle (α) being an angle between the loading arm and a horizontal plane, the activating device comprising:
an activating element (23), a spindle (22) mounted on the frame (20), which is in drive connection with the activating element (23) and configured to rotated about a spindle axis (24), a spindle nut (25) with at least one guiding element (26), a connecting link (27) secured to the loading arm (18), one end of the connecting link is pivotally mounted on the pivot axis of the loading arm, the connecting link comprising an internal slot defined along substantially an entire length of the link between the one end and a second end of the connecting link, and said connecting link (37) cooperating with the at least one guiding element (26) of the spindle nut (25) so that the at least one guiding element is moved along the connecting link within the internal slot, wherein the connecting link (27) is configured such that a force required to move the at least one guiding element (26) is a function of the loading arm setting angle ($\alpha$), and wherein the connecting link (27) has a curved configuration, so that with a given activation force of the activating element (23), a lifting force, which is exerted via the adjusting element (23) on the loading arm (18), is greater at small setting angles ($\alpha$) than at larger setting angles ($\alpha$).

* * * * *